US005730023A

United States Patent [19]

Gmeilbauer

[11] Patent Number: 5,730,023

[45] Date of Patent: Mar. 24, 1998

[54] DENT REMOVAL HAMMER WITH ACCESSORIES FOR REPAIRING DENTED METAL SHEETS

[76] Inventor: Engelbert Gmeilbauer, Stocketweg 1, 82229 Seefeld, Germany

[21] Appl. No.: 690,162

[22] Filed: Jul. 19, 1996

Related U.S. Application Data

[63] Continuation-in-part of PCT/EP95/00207 Jan. 20, 1995 published as WO95/19855 Jul. 27, 1995.

[30] Foreign Application Priority Data

Jan. 21, 1994 [DE] Germany ..... 44 01 717.0

[51] Int. Cl.[6] ..... B21D 1/12

[52] U.S. Cl. ..... 72/479; 72/481.3; 72/705

[58] Field of Search ..... 72/705, 457, 479, 72/477, 481.1, 481.3, 445; 81/463; 173/90, 91, 128, 132

[56] References Cited

U.S. PATENT DOCUMENTS

| | | | |
|---|---|---|---|
| 1,783,077 | 11/1930 | Ferguson . | |
| 2,701,359 | 2/1955 | Asbury . | |
| 3,519,087 | 7/1970 | Santi . | |
| 4,235,090 | 11/1980 | Wightmann et al. | 72/705 |
| 4,429,562 | 2/1984 | Hultquist | 72/705 |
| 4,502,317 | 3/1985 | Hultquist | 72/705 |
| 4,703,549 | 11/1987 | Grandt | 173/91 |
| 4,753,104 | 6/1988 | Strozier | 72/705 |
| 5,329,802 | 7/1994 | Nunez | 72/705 |
| 5,461,900 | 10/1995 | Gutierrez | 72/705 |

FOREIGN PATENT DOCUMENTS

| | | |
|---|---|---|
| 2 600 572 | 6/1986 | France . |
| 1 652 621 | 4/1971 | Germany . |
| 2 207 284 | 9/1972 | Germany . |

*Primary Examiner*—Lowell A. Larson
*Assistant Examiner*—Ed Tolan
*Attorney, Agent, or Firm*—Klaus J. Bach

[57] ABSTRACT

In a dent removal hammer for repairing dented metal panels, a hardened impact head with an operating rod is movably disposed in a hollow cylinder which has an anvil cylinder mounted on its front end and an anvil sleeve mounted at its rear end, with the operating rod extending through the anvil sleeve and having at its free end outside the hollow cylinder a handle for actuating the impact head so as to impact onto the anvil cylinder or the anvil sleeve for transmitting forward or backward impact forces to an anvil inset attachment mounted on the anvil cylinder.

9 Claims, 7 Drawing Sheets

Fig. 3a
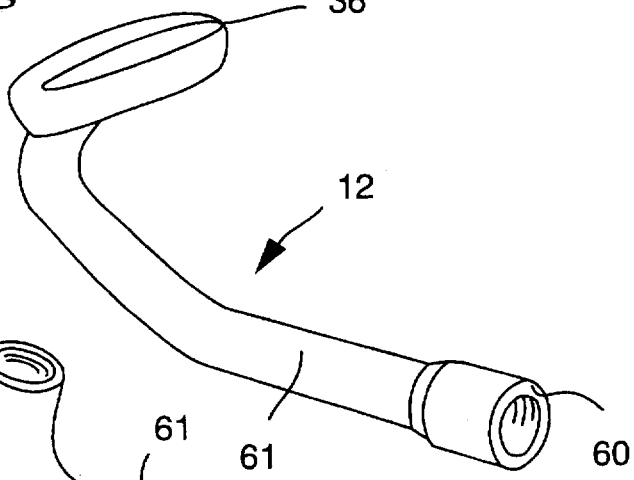
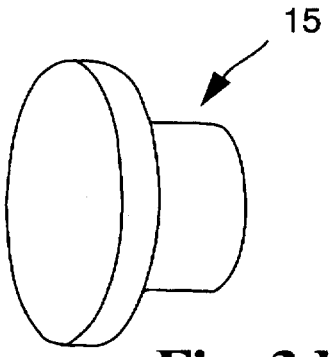
Fig. 3d
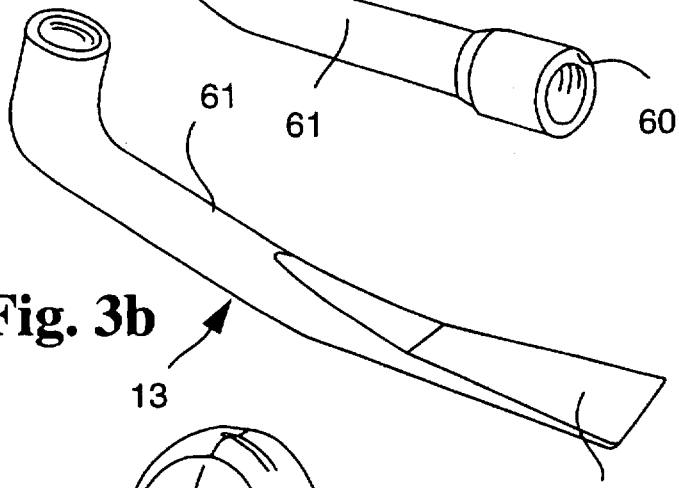
Fig. 3b
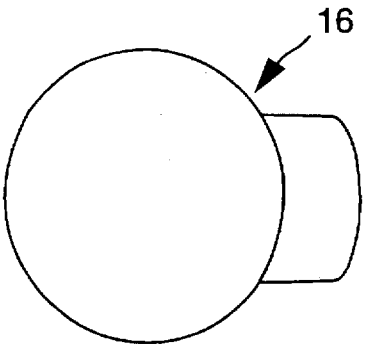
Fig. 3e
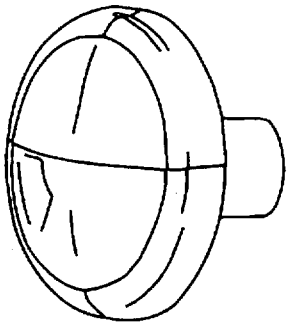
Fig. 3c
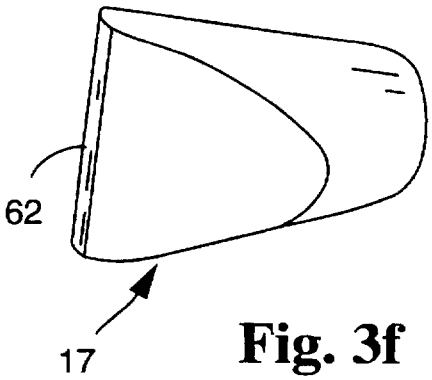
Fig. 3f

12 m
36
A
M
C
p
O
n
a
B
D
b
61
62

36
q
61
62
36
n
q 62
61
61
p
36
62

DENT REMOVAL HAMMER WITH ACCESSORIES FOR REPAIRING DENTED METAL SHEETS

This is a continuation-in-part application of international patent application PCT/EP95/00207 filed on Jan. 20, 1995, published as WO95/19855 Jul. 27, 1995, and claiming the priority of German patent application P 44 01 717.0 filed Jan. 21, 1994.

BACKGROUND OF THE INVENTION

The invention relates to a dent removal hammer or dent removal tool for repairing dented metal sheets, particularly a dent removal hammer as it is used in body shops for repairing dented auto bodies especially in accessible areas.

For repairing dented areas of automotive body panels dent removal hammers are generally used which have different sizes and shapes dependent on the type of the dents (area and dent depth, accessibility of the dent etc.) and which have generally the classic shape of a manually operated hammer with an impact body extending transverse to the handle. Such (manual) dent removal hammers are appropriate if the area to be repaired is easily accessible and if there is sufficient space for swinging the hammer and controlling its impact. However, in many cases, damage to auto bodies does not provide for these conditions so that the available dent removal hammers are not usable or, if used, the results are not satisfactory. The dent removal hammers known in the art further have the disadvantage that for the repair of a particular damage, it is generally necessary to use a plurality of hammers of different sizes and shapes, that they cannot be effectively used in inaccessible areas (so that other more expensive procedures must be utilized such as welding pins to the dented metal which is then pulled out by the pins) and that impact forces can be applied only in an inward direction, not in a pulling direction.

Further, pneumatically operated hammers are known in which an impact body is operated by a motor in such a way that, in contrast to the manual tools described above, also relatively little space is needed for impacting the body. However, these motor operated hammers are relatively expensive because of the needed drive unit and because of a more involved design, they do not give the operator the feel needed for certain dent removal procedures and they are generally very noisy because of the drive unit.

It is the object of the invention to provide a manually operated dent removal hammer by which dents in metal panels can be rapidly and cleanly removed even if the dented area is not easily accessible.

SUMMARY OF THE INVENTION

In a dent removal hammer for repairing dented metal panels, a hardened impact head with an operating rod is movably disposed in a hollow cylinder which has an anvil cylinder mounted on its front end and an anvil sleeve mounted at its rear end, with the operating rod extending through the anvil sleeve and having at its free end outside the hollow cylinder a handle for actuating the impact head so as to impact onto the anvil cylinder or the anvil sleeve for transmitting forward or backward impact forces to an anvil inset attachment mounted on the anvil cylinder.

Additional impact weights may be attached to the handle which provide for an increased mass and consequently for greater impact forces or for improved handling. At the cylinder end opposite the handle the cylinder is provided with a support arrangement for attachments, that is repair tool parts, which are used for applying forces to the dented area to be repaired in a certain desired way made possible by the attachment. The exchangeable attachments or accessories are differently shaped to provide, depending on the size and the shape of the dented metal sheet area and dependent on the accessibility to the dented area within the auto body, an optimum action area for the forces to be applied.

With the arrangement described above the handle including the operating rod and the hardened impact head are movable axially relative to the cylinder of the dent repair tool in a way similar to a piston hand pump such as a bicycle pump whose piston is movable within the pump cylinder. The lengths of the operating rod, the hardened impact head and the cylinder are, in accordance with the invention, so selected that the handle end of the operating rod still projects somewhat from the cylinder if the operating rod including the hardened impact head are fully inserted into the cylinder up to the end stop, that is, the operating rod is longer than the cylinder stroke length. In a first embodiment of the dent removing tool according to the invention a spiral compression spring is disposed outside the cylinder around the operating rod between the handle and an impact sleeve in order to provide a return force which pushes the operating rod back out of the cylinder after it has been fully inserted into the cylinder. In a second embodiment of the dent removing tool according to the invention such a spiral compression spring for returning the operating rod is not provided.

If now, a dented metal sheet is to be repaired an anvil inset stake (exchangeable accessory) is selected depending on the dent and on the accessibility thereto and the toolis placed, with the selected anvil inset, onto the area to be repaired. For this purpose, the cylinder of the dent removal hammer is grasped with one hand while the handle is grasped with the other hand. If the dent is to be repaired by a forward impact (pushing) then the handle and associated operating rod and hardened impact head are slowly moved out of the cylinder held with the one hand up to an anvil sleeve at the outer cylinder end. Then the handle is pushed back into the cylinder with a rapid movement of the other hand. This causes the impact head which is connected to the handle by way of the operating rod to impact onto an anvil cylinder at the distant end of the cylinder to which the anvil inset is attached. Since the operating rod length is greater than the cylinder stroke length the insert movement of the operating rod and the hardened impact head into the cylinder is abruptly stopped by the impact of the impact head onto the anvil cylinder whereby a large impact force is transmitted to the anvil cylinder and the anvil inset stake and to the metal sheet area to be repaired. By varying the stroke length and the force with which the handle and the operating rod are pushed into the cylinder and by mounting additional weights on the handle by which greater forces can be generated because of the greater mass, the intensity of the impact force applied to the dented area by the anvil inset tool can be controlled. With a proper selection of the anvil inset tool or accessory depending on the dented area to be repaired an optimal shaping effect can be achieved. The dent removal hammer according to the invention also requires only little working space compared with the swing hammers normally used for dent removal. Also, the location and direction of the impact can be carefully controlled. This is particularly advantageous if the repair work has to be done in tight areas for example, in the area between two spaced metal sheets (for example, a double wall car door) since there is hardly any place for swinging a hammer. The anvil inset accessory of the dent removal tool according to the invention, on the other hand, can be easily inserted into relatively small cavities. The insert opening has to be sufficiently large only to accommodate the anvil inset accessory or, respectively, the cylinder. Space for generating the impact force needs to be available only in the axial direction of the cylinder axis of the dent removal hammer according to the invention which should normally be no problem in practice.

The dent removal hammer according to the invention however, has further important advantages: in comparison with a swing hammer which is guided by way of an arm and hand movement of the operator whereby large forces are applied to the arm and hand joints of the operator, with the dent removal tool according to the invention the weight is concentrated in by the tool cylinder which only has to be held in position by the operator. No impact forces are transmitted to the joints of the operator. The use of the dent removal tool according to the invention is therefore less tiring than the use of a swing hammer which because of tiring of the operator would lead to a reduction of operating precision after a relatively short time. Further, the dent removal tool according to the invention is ergonomically more advantageous than a swing hammer since the impact forces are transmitted by the impact head directly to the anvil cylinder in a straight line so that no reaction forces act on the joints of the operator. For the application of very large impact forces, in contrast to swing hammers which have to be handled by a single person, two or more persons can be employed for the task. For example, one person may hold the cylinder with both hands while a second person moves the handle with both hands in- or outwardly. If several subsequent impacts are to be applied to the dented area, it is advantageous if the tool is provided with the spiral compression spring mentioned earlier since it will return the operating rod automatically after each impact stroke at least to a certain degree. This permits the operator to concentrate on the movement of the operating rod in one direction which is less tiring for the operator as it provides automatically for a certain operating rhythm.

With the dent removal tool according to the invention, it is possible to move the operating rod with the impact head not only forward to impact onto the anvil cylinder but also backward toward the handle end for impact on the anvil sleeve at the handle end of the cylinder. This is particularly advantageous for repair work on autobody panels. For this purpose, an anvil inset stake (replaceable accessory) is used which is angled at one or more locations. With the angled areas, the anvil inset is wedged in the dented area while, again, the cylinder of the dent removal hammer according to the invention is grasped and, with the operating rod fully inserted is properly oriented with respect to the dented area. Then the handle together with any weights mounted thereon is rapidly pulled out whereby the operating rod and the impact head are moved outwardly until the hardened impact head impacts on the anvil sleeve disposed at the operating end of the cylinder (that is, remote from the anvil insert) where it is suddenly stopped. This generates a large pulling force on the anvil insert accessory wedged in the dented metal sheet. The intensity of the pulling forces can be adjusted by changing the length of the operating stroke the force with which the handle is pulled and by attaching additional weights to the handle.

For an optimal transmissions of the impulse forces from the movable part (handle, possibly with additional weights, operating rod and hardened impact head) to the exchangeable anvil inset attachment, it is necessary to adapt the mass of the stationary parts (cylinder, anvil sleeve, anvil cylinder) to the mass of the movable parts depending on the desired intensity of the impact (on the basis of weight ratio). This can be done by an auxiliary weight which can be mounted on the cylinder by a sleeve engaged between stops and which can serve as counter weight for taring the movable masses.

If the sleeve is omitted the auxiliary weight is axially movable on the cylinder and can further be used to apply the very large impact forces as they are generallyneeded for aligning body frame parts of an automobile. For this purpose, the auxiliary weight includes grasping handles for example in the form of transverse rods screwed into the weight. If such an auxiliar weight is mounted onto the cylinder the cylinder is provided with stops for example in the form of cap screws which are screwed onto the ends of the cylinder and which limit axial movement of the auxiliar weight on the cylinder. Furthermore, the other parts which are axially movable relative to the cylinder, that is the handle with the impact weights and the operating rod with the hardened impact head are moved to their maximum extended positions (thats up to the anvil sleeve under the cylinder cap screw). Then one person pulls on the handle and/or the the additional weights so as to bring the dent removal hammer according to the invention, which is wedged with its exchangeable anvil inset tool in the body frame structure to be straightened, into the desired operating direction. Two other persons then grasp the grasping handles projecting in opposite directions from the auxiliary weight. Together they move then the auxiliary weight relative to the cylinder, which is held in position by the first person, to the inner travel end near the attachment end of the cylinder. Then the two persons pull the auxiliary weight rapidly with full power so that the heavy auxiliary weight impacts on the outer stop that is the cap screw mounted around the cylinder whereby very high impact pulling forces are developed as they are often required for the straightening of body frame parts. The impact forces are transmitted, via the cap screw to the cylinder and from the cylinder to the anvil cylinder and to the anvil inset attachment.

Accordingly, the dent removal hammer according to the invention permits pointed force application and accurate dosing of the impact forces for a multitude of requirements and, with exchangeable accessories can be adapted to particular circumstances.

The invention will be described below on the basis of the accompanying drawings.

BRIEF DESCRIPTION OF THE DRAWINGS

FIGS. 3*a*, 3*b*, 3*c*, 3*d*, 3*e* and 3*f* are perspective views of various anvils insert accessories.

DESCRIPTION OF PREFERRED EMBODIMENTS

Figure 1:
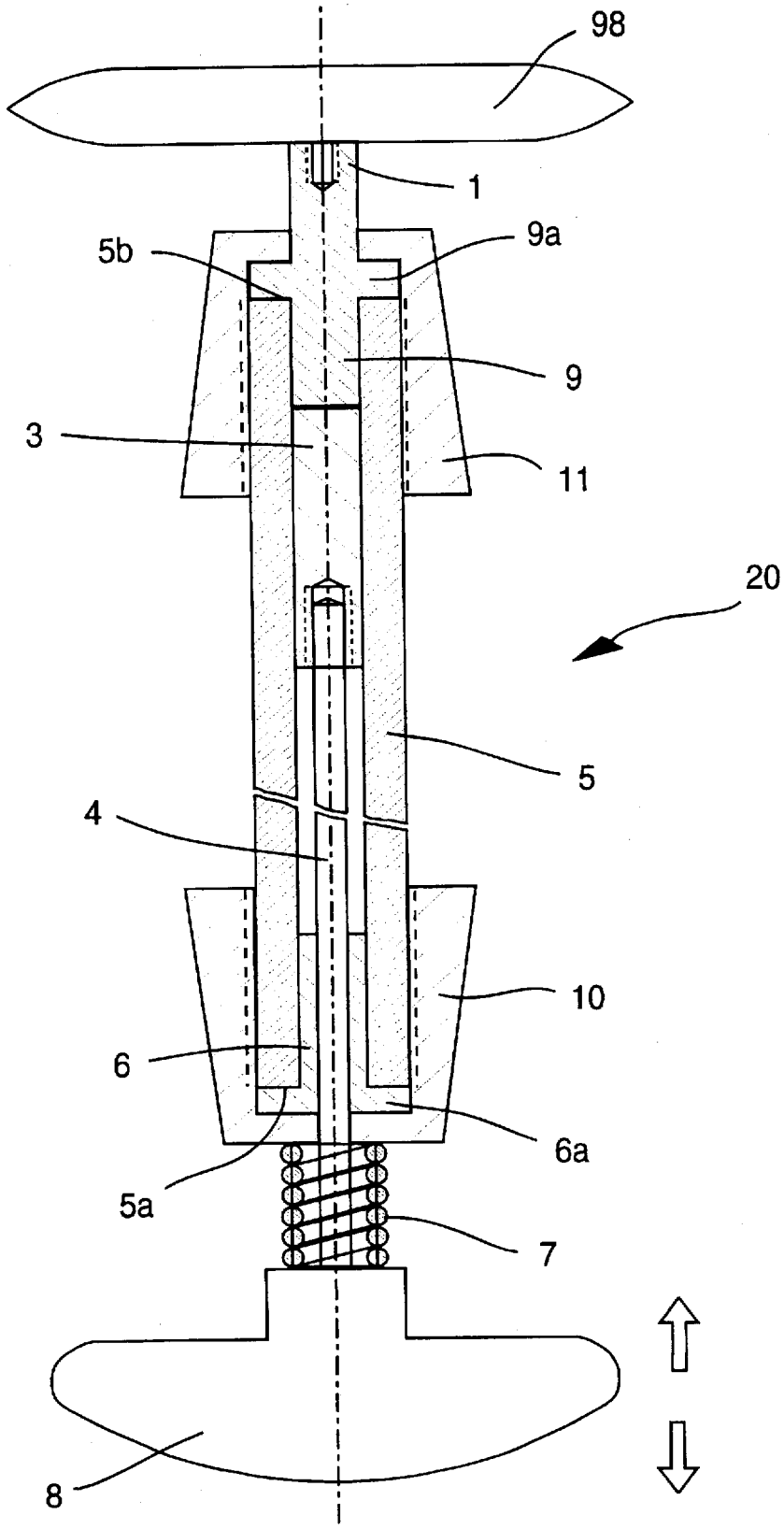
FIG. 1 is a cross-sectional view of a dent removal hammer according to the invention with a spiral compression spring disposed around its operating shaft and an exchangeable anvil insert accessory mounted to the anvil cylinder.

FIG. 1 shows a first embodiment of a dent removal hammer 20 with a spiral compression spring 7 and an exchangeable anvil inset tool 98. The dent removal hammer 20 comprises a hollow cylinder 5, in which a hardened impact head 3 is disposed so as to be movable therein along the axis of he hollow cylinder 5. The hardened impact head 3 is mounted at one end to an operating rod 4. To limit movement of the hardened impact head 3 in an axial direction, an anvil sleeve 6*a* is mounted at one end 5*a* of the hollow cylinder 5 and an anvil cylinder 9 is mounted on the other end 5*b* of the hollow cylinder 5. At its end opposite the impact head 3, the anvil cylinder 9 is provided with means for mounting accessory tools, that is, the exchangeable anvil inset stake comprising various tools 12 to 17. The accessory tool 98 as shown in FIG. 1 is mounted by way of a bolt screwed into a threaded opening in the anvil cylinder 9. The end of the operating rod 4 opposite the hardened impact head 3 extends through the anvil sleeve 6 and has outside the cylinder 5 a threaded end onto which a handle 8 is screwed. In the dent removal hammer 20 shown in FIG. 1, the anvil sleeve 6 and the anvil cylinder 9 are provided with flanges 6*a* and 9*a* which are disposed on the end faces 5*a* and 5*b* of the hollow cylinder 5 and are firmly engaged with the cylinder 5 by cap screws 10 and 11.

The handle 8, the operating rod 4 and the hardened impact head 3 and, resectively, the hollow cylinder 5, the anvil sleeve 6, the anvil cylinder 9 and the cap screws 10 and 11 form unitary partial structures which are movable relative to one another and are interconnected like the parts of a bicycle pump. Since the operating rod 4 with the hardened impact head 3 is longer than the stroke length of the hollow cylinder 5, impact forces can be applied to the anvil cylinder 9 and, via the anvil inset tool 98 mounted onto the anvil cylinder 9 by a mount 1 to a workpiece by pushing the handle 8 rapidly inwardly. If the handle 8 is pulled rapidly outwardly the impact head 3 hits the anvil sleeve 6 whereby pulling forces are applied to the anvil inset tool 98.

In the dent removal tool 20 as shown in FIG. 1 the operating rod 4 is fully inserted into the hollow cylinder 5. The outer end of the operating rod 4 carrying the handle 8 is shown projecting from the end 5*a* of the cylinder 5. As described above, the impact head 3 hits the anvil sleeve 6 if the handle 8 is pulled out of the cylinder 5 and it hits the anvil cylinder 9 when the handle 8 with the operating rod 4 and the impact head 3 is pushed into the cylinder 5. The spiral compression spring 7 disposed outside the cylinder 5 between the handle 8 and the anvil sleeve 6 around the operating rod 4 retrieves the operating rod 4 automatically at least partially each time the operating rod 4 is pushed into the cylinder.

Figure 2:
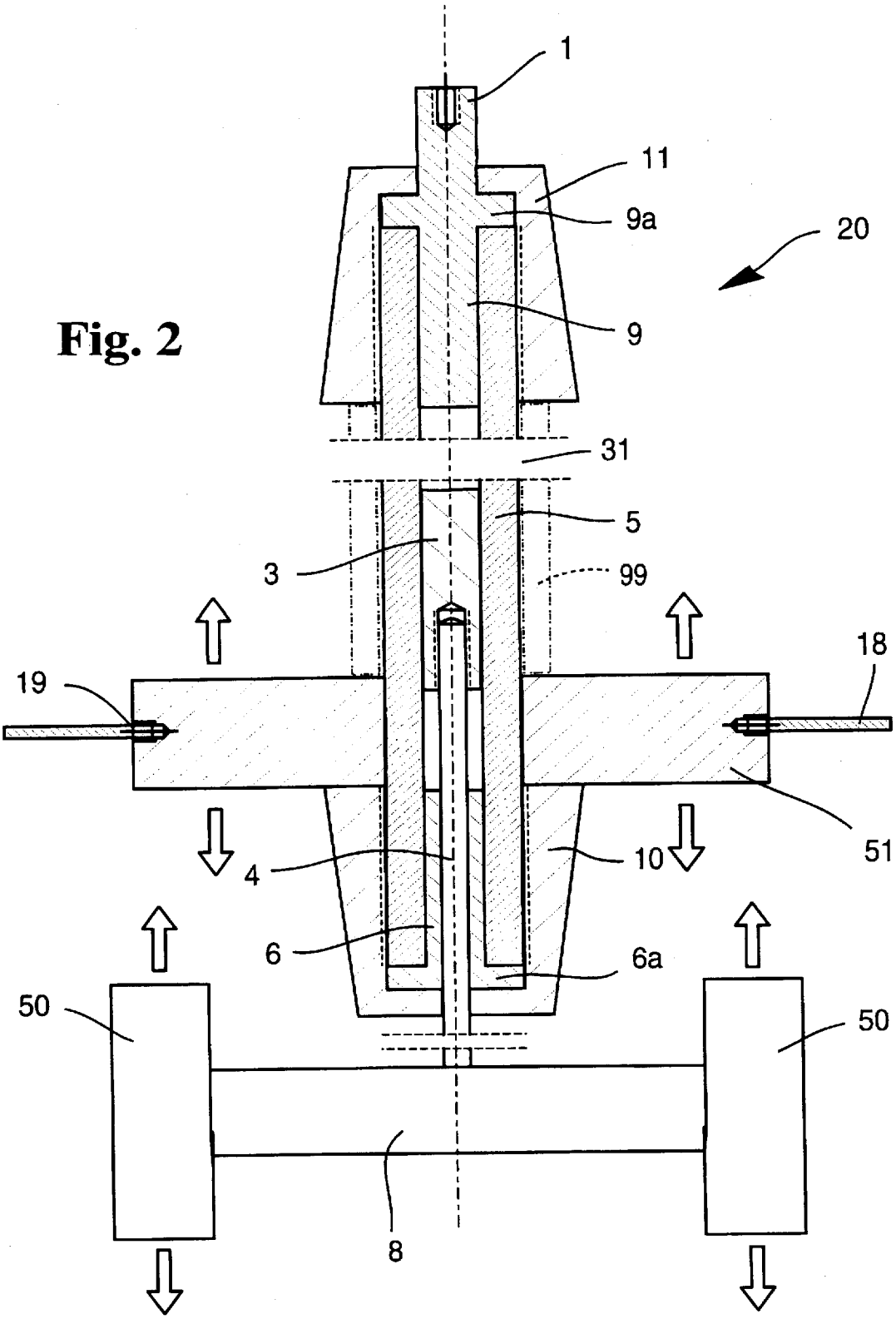
FIG. 2 is a cross-sectional view of another embodiment of the dent removal hammer without spiral compression spring but with an impact-increasing auxiliary weight and a sleeve for holding the auxiliary weight in place.

FIG. 2 is a cross-sectional view of an embodiment of the dent removal hammer according to the invention without a spiral compression spring and without an anvil inset accessory too wherein two additional impact weights 50 are mounted onto the handle 8 which, because of their masses provide for additional impact forces to be applied to the anvil inset accessory (not shown). The additional impact weights 50 are removably mounted onto the handle 8 so that the dent removal hammer can be easily adapted to the work to be performed.

The cap screw 11 can be easily removed and auxiliary weight 51 can then be mounted onto the cylinder 5 for taring the stationary and movable parts (handle 8 with impact weights 50, operating rod 4, hardened impact head 3). By also mounting a retaining sleeve 99 (shown in FIG. 2 in dash-dotted lines) onto the hollow cylinder 5, the auxiliary weight 51 can be firmly engaged between the cap screws 10 and 11.

Figure 6:
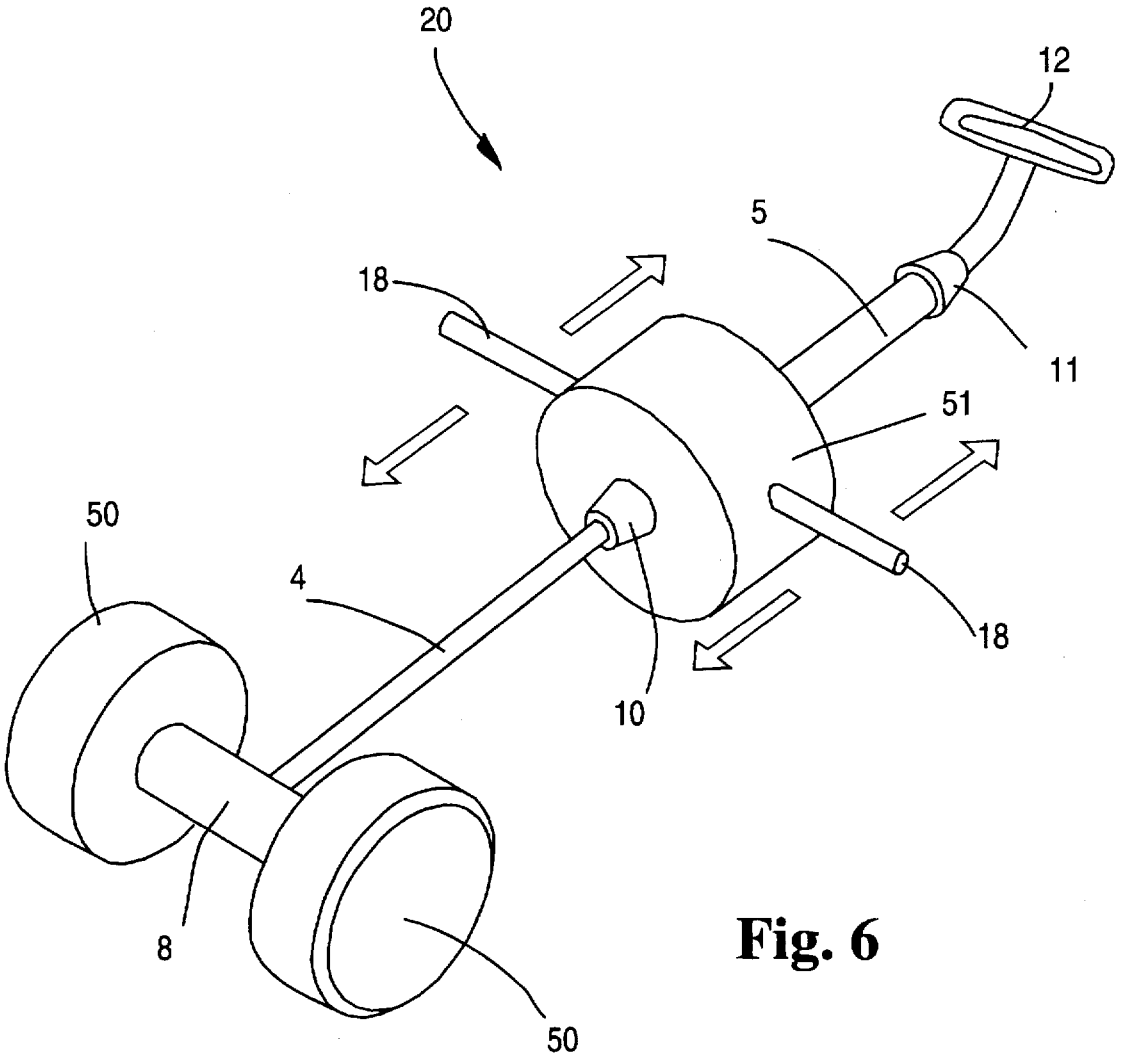
FIG. 6 illustrates the use of the dent removal tool as shown in FIG. 5 wherein the auxiliary weight of FIG. 2 is provided with operating handles for applying high impact forces in a pulling direction.

If the retaining sleeve 99 is omitted the auxiliary weight 51 is freely movable on the hollow cylinder 5 back and forth between the cap screws 10 and 11. As shown in FIG. 2, the auxiliary weight 51 has two handle portions 18 which are screwed into bores 19 provided in the auxiliary weight 51 for that purpose. The preassembled auxiliary weight 51 is placed onto the cylinder 5 of the dent removal hammer 20 as shown in FIG. 2. The handle portions 18 facilitate the holding of the tool by two persons. As described earlier the handle 8 and the components connected thereto are pulled out of the cylinder 5 until the hardened impact head 3 abuts the anvil sleeve 6 and the dent removal hammer with the anvil inset attachment wedged in the dented metal sheet is grasped by a person by the handle 8 and/or the additional impact weights 50 and is properly oriented in the desired pulling direction. The use of the auxiliary weight 51 for pulling in connection with the dent removal hammer 20 shown in FIG. 2 and with the anvil inset attachment 12 of FIG. 3*a* is shown in FIG. 6. Then, two additional persons each grasping one of the handle portions 18 can pull the auxiliary weight 51 back to impact on the cup screw 10 and the tool 12 for aligning body frame parts.

It is also possible to provide a handle portion 8 with an ergonomically better shape than the simple cylindrical bodies shown in FIG. 2. They may have parts with a shape to accommodate a hand (not shown). Also, the flanges 6*a* and 9*a* described above and, if the auxiliary weight 51 is not to be used, also the cap screws 10 and 11 screwed onto the cylinder 5 may be omitted. Instead, an arrangement may be provided wherein the anvil sleeve 6 and the anvil cylinder 9 are provided with an outside thread by which they are screwed into an internal thread in the interior of the hollow cylinder 5 or a separate mount 1 may be provided by which the anvil cylinder 9 is firmly connected to the mount 1. With all these embodiments of the dent removal hammer according to the invention, it is important however, that the handpump-like arrangement of the hollow cylinder and the operating rod with the hardened impact head movably received in the hollow cylinder is maintained and that the masses of movable and stationary components are tared for optimal impact pulse transmission. In order to prevent a compression of air in the hollow cylinder 5 between the anvil cylinder 9 and the impact head 3 when the handle 8 is moved into the hollow cylinder 5 which would reduce the impact forces, there may be provided vent openings 31 (FIG. 2) in an upper portion of the hollow cylinder 5 through which the air can escape. This problem (of air compression) will generally not occur when the operating rod 4 is pulled out of the cylinder 5 since the air can escape from the space between the impact head and the anvil sleeve 6 through the opening for the operating rod 4.

FIGS. 3*a*–3*f* show accessories (anvil inset stakes) which can be attached to the dent removal hammer 20 according to the invention. There are provided attachments with spherical or semispherical or with flattened engagement ends 16, 14, 15 (FIGS. 3*e*, 3*c*, 3*d*) or with a more or less dulled engagement surface 62 and a wedge-shaped end 17 (FIG. 3*f*) (setting tool). The exchangeable attachment tools can all be used for applying forward impact forces wherein the handle 8 is rapidly moved toward the cylinder 5 of the dent removal tool 20. Depending on the type of sheet metal damage the most suitable tool attachement is selected. On the other hand, the tool attachement may be angled for pulling (backward impact) or for pulling and for pushing. FIG. 3*b* shows an attachment 13 that can be screwed onto the mount 1 (with outside thread) and which has a front end extending at an angle to the axis of the hollow cylinder 5. It has a flattened spoon-like area 41 which is used for the removal of dents in the side area of a car door which area is not directly accessible because of the interior door panel structures. The attachment 13 can be inserted behind the interior door panel structure for engagement with the dented area to be straightened out. With sudden pushing onto the handle 8 and firmly engaging the dented area by pressing the cylinder 5 toward the dented area, the impacts can be transmitted to the dented area in a well directed and controlled manner. If, for repairing the dented area, a large number of impacts have to be applied in succession, an embodiment of the dent removal tool according to the invention which includes a spiral compression spring 7 (FIG. 1) is advantageous since it facilitates the return movement of the operating rod 4.

The flattened spoon-like area 41 of the tool 13 however may also be placed into the interior of a dented area to be lifted and may be wedged therein. If then the handle 8 of the dent removal tool 20 is suddenly pulled outwardly, relatively large momentary pulling forces can be applied by the tool 13 to the dented metal for lifting the dented area.

Figures 7A, 7B, 7C, 7D:
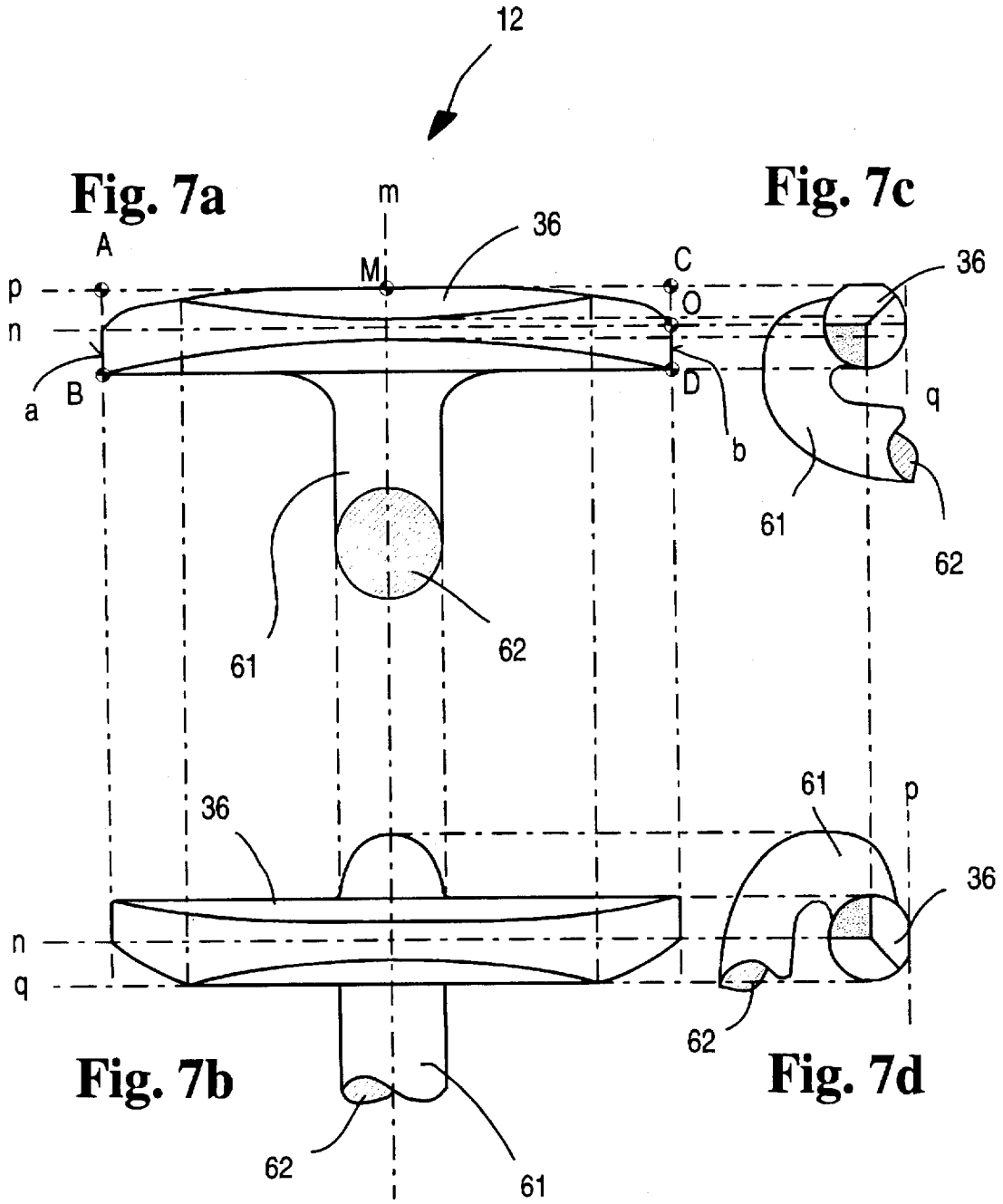
FIG. 7*a*, 7*b*, 7*c*, and 7*d* are various views of the anvil insert accessory shown in FIG. 3*a*.

The shaping tool 12 shown in FIG. 3*a* is also suitable for applying pushing and pulling impact forces to dented metal panels of an auto body part. For removing dents from the edge areas of the fender, for example, the tool 12 is screwed with its threaded end 60 onto the mount 1 and is placed with its impact structure 36 which extends transverse to its shaft 61, behind the flanged edge of the fender. By sudden pulling on the handle 8, the dented area can then be straightened out. FIGS. 7*a* to 7*d* show different views of such a tool 12. FIG. 7*a* is a view where the observation plane intersects the shaft 61 of the anvil inset tool 12. FIG. 7*b* is a view in which the anvil inset tool 12 is turned by 90° about the axis is of the essentially cylindrical multiple impact structure 36. FIGS. 7*c* and 7*b* are side views of the anvil inset tool 12 of the respective FIGS. 7*a* and 7*b* (the anvil insert tools 12 being turned 90° from the position shown in FIGS. 7*a* and 7*b* about the axis n of the impact structure 36). The typical shape of the impact structure 36 which extends normal to angled shaft 61 could be obtained in the following manner: From a circular cylinder which extends normal to the shaft 61 (and whose shape is indicated in FIG. 7*a* by the points A, B, C, D) material is removed in a curved stroke extending from the intersection M of the axis m with the plane p (extending parallel to the tangential plane to the cylinder envelope which extends in viewing direction and which intersects the cylinder envelope) which extends parallel to the viewing direction of FIG. 7*a*, and is curved near the cylinder end surfaces a and b toward the axis m (that is, the area between the points M and O of the circular cylinder is removed). Then material is removed in a second stroke which is symmetrical to the first stroke with respect to the axis m. The body so obtained is then rotated along the cylinder axis n by 90°. Then material is removed in a third stroke which extends from the plane 9 (which is normal to the plane p) in a direction parallel to the viewing direction of FIG. 7*b* and which is curved adjacent the cylinder end faces a, b toward to axis m. Then in a fourth stroke, which is symmetrical to the third stroke with respect to the axis m, additional material is removed.

Figure 4:
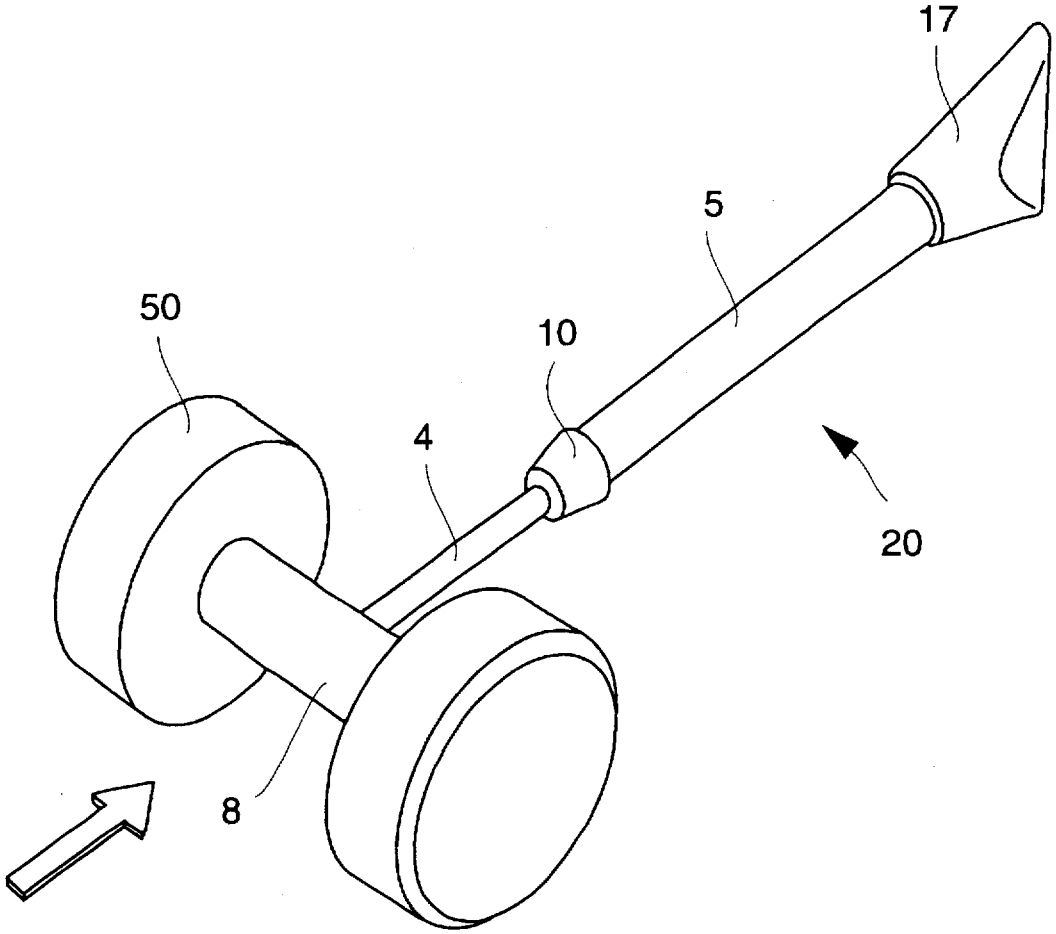
FIG. 4 illustrates the use of the dent removal tool with additional impact weights mounted on its handle and the accessory of FIG. 3*f* mounted on the anvil cylinder.
Figure 5:
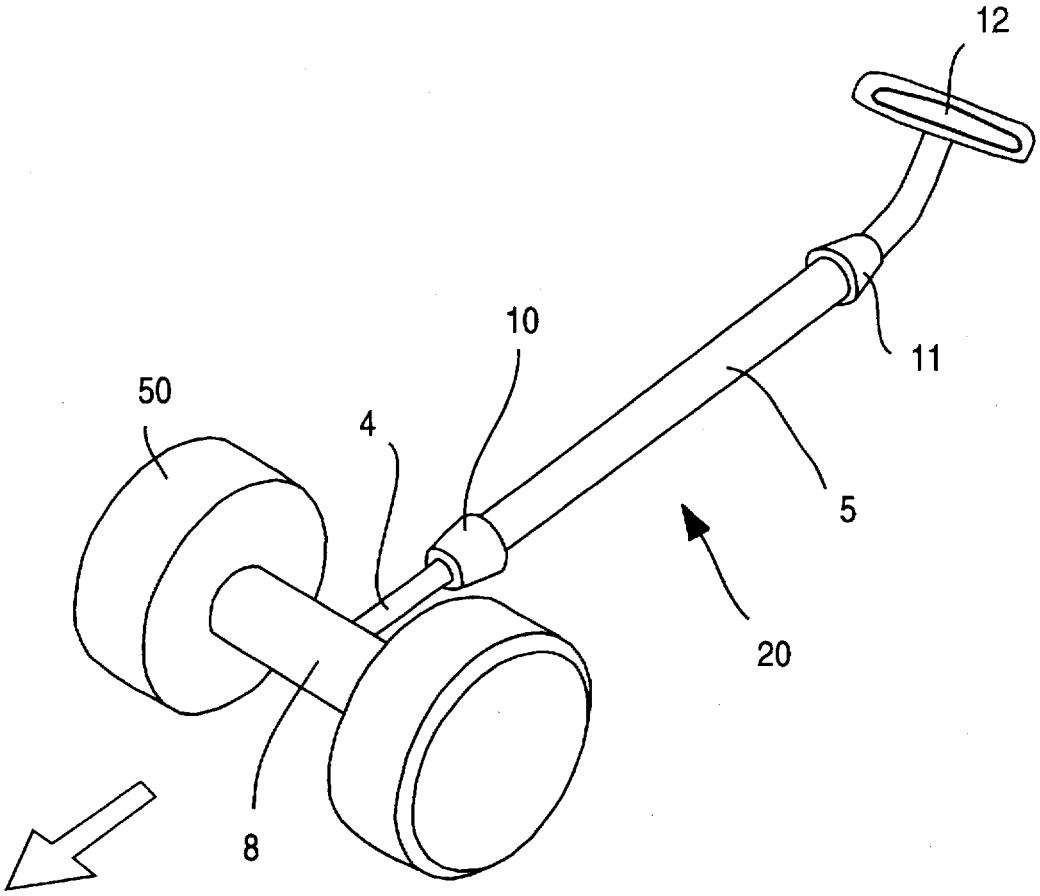
FIG. 5 illustrates the use of the dent removal tool with additional weights mounted on its handle and the accessory of FIG. 3*a* mounted on the anvil cylinder.

FIGS. 4 and 5 show a dent removal hammer 20 of the type shown in FIG. 2 with additional impact weights 50 attached and with an anvil inset tool 12 screwed onto the mount 1 wherein the dent removal tool 20 is used, in one case (FIG. 4) for forward impacts and, in the other case (FIG. 5) for rearward impacts.

What is claimed is:

1. A dent removal hammer for repairing dented metal panels, comprising; a hollow cylinder having a front end and a rear end, an anvil cylinder extending into said front end and having a collar disposed on said front end, a cap nut mounted on said front end of said hollow cylinder so as to firmly engage said anvil cylinder with said hollow cylinder, an anvil sleeve extending into said rear end and having a collar disposed on said rear end, a cap nut mounted on said rear end of said hollow cylinder so as to firmly engage said anvil sleeve with said hollow cylinder, a hardened impact head movably disposed in said hollow cylinder, an operating rod extending through said anvil sleeve into said hollow cylinder and being connected within said hollow cylinder to said hardened impact head, said operating rod being sufficiently long so as to project from said hollow cylinder when said impact head abuts said anvil cylinder and having a free end extending from said hollow cylinder, a handle mounted on said free end of said operating rod for actuating said impact head, and means for mounting an anvil inset tool onto said anvil cylinder so as to permit the transmission of impact forces applied to said anvil cylinder to said inset tool.

2. A dent removal hammer according to claim 1, wherein additional impact weights are removably mounted on said handle.

3. A dent removal hammer according to claim 1, wherein a spiral compression spring is disposed around said operating rod between the rear end of said hollow cylinder and said handle.

4. A dent removal hammer according to claim 1, wherein an auxiliary weight with handle portions is disposed on said hollow cylinder so as to be axially movable thereon.

5. A dent removal hammer according to claim 4, wherein, in addition to said auxiliary weight, a sleeve is mounted on said hollow cylinder, said sleeves having a length such that said sleeve and said auxiliary weight tightly fit between said cap screws and are firmly engaged therebetween such that said auxiliary weight is securely located.

6. An anvil inset attachment to the dent removal hammer according to claim 1, wherein said attachment has at its free end a flat, spherical, semispherical or a conical shape.

7. An anvil inset attachment to the dent removal hammer according to claim 1, wherein a working area is provided at the end of said anvil inset attachment remote from said mount which is angled away from the axis of said hollow cylinder of said dent removal hammer.

8. An anvil inset attachment according to claim 7, wherein said working area angled away from the axis of said hollow cylinder comprises a flat spoon-like portion.

9. An anvil inset attachment according to claim 7, wherein said attachment has at its free end an impact structure extending from the shaft of said attachment in opposite directions and having a base shape of a cylinder with a basic circular cross-section shaped by a material removal stroke extending symmetrically in opposite directions from the center of said cylinder to the end faces of said cylinder and another material removing stroke extending normal to the first stroke from the center of said cylindrical base shape to the cylinder end faces.

* * * * *